United States Patent [19]

Jacobi

[11] Patent Number: 4,949,878

[45] Date of Patent: Aug. 21, 1990

[54] REUSABLE CONTAINER SYSTEM

[75] Inventor: Stephen V. Jacobi, Ballwin, Mo.

[73] Assignee: Monsanto Company, St. Louis, Mo.

[21] Appl. No.: 289,898

[22] Filed: Dec. 27, 1988

[51] Int. Cl.[5] ..... B67D 5/40

[52] U.S. Cl. ..... 222/382; 220/86.4; 220/203; 220/265; 222/153; 222/147; 222/482

[58] Field of Search ..... 137/320, 587, 583; 220/86 R, 86 AT, 86 NR, 203, 254, 265; 222/211, 153, 147, 382, 464, 482

[56] References Cited

U.S. PATENT DOCUMENTS

| | | | |
|---|---|---|---|
| 646,527 | 4/1900 | Linton | 222/464 |
| 948,325 | 9/1910 | Heffernan . | |
| 1,772,141 | 8/1930 | Glass | 222/464 |
| 1,960,532 | 5/1934 | Dunham | 220/86 NR |
| 1,967,358 | 7/1934 | Gianellont | 220/86 NR |
| 1,977,328 | 10/1934 | Sousley | 222/464 |
| 1,994,334 | 3/1935 | Buono | 215/25 |
| 2,069,005 | 1/1937 | Damsel et al. | 215/28 |
| 2,083,776 | 6/1937 | Ferguson | 222/464 |
| 2,089,777 | 8/1937 | Young . | |
| 2,195,321 | 3/1940 | Sabatt et al. | 220/86 |
| 2,258,637 | 10/1941 | Young et al. . | |
| 2,723,781 | 11/1955 | Funke | 222/382 |
| 3,405,837 | 10/1968 | Carpenter | 220/265 |
| 4,597,507 | 7/1986 | Rosenblum et al. | 222/16 |
| 4,630,759 | 12/1986 | Dawn | 222/377 |

*Primary Examiner*—H. Grant Skaggs

*Attorney, Agent, or Firm*—Senniger, Powers, Leavitt and Roedel

[57] ABSTRACT

A reusable container system comprising a container for holding a bulk quantity of liquid or other fluent material. The container has top, bottom and side walls, a port in the top wall of the container, a closure for the port having a tamper-evident connection with the container for indicating removal of the closure from the container, and a suction tube assembly attached to the closure and extending down into the container. A one-way check valve in the suction tube assembly permits flow of liquid out of the container but prevents flow into the container through the suction tube. The closure on the port is formed for releasable connection of a pump thereto whereby, after arrival of the container at a location where the contents of the container are to be dispensed, a pump may be releasably connected to the closure and then actuated to pump liquid from the container via the suction tube assembly. When the container is emptied the pump may be disconnected from the closure for transport of the container to another location for refilling. A method of using the system is also disclosed.

39 Claims, 3 Drawing Sheets

REUSABLE CONTAINER SYSTEM

BACKGROUND OF THE INVENTION

This invention relates generally to containers, and more particularly to a reusable container system, a container for such a system, and a method of using such a system.

Increasing waste disposal concerns have for years caused industry to look for ways to economically refill and reuse containers for various products. However, reuse of containers has heretofore been time-consuming and expensive, primarily because emptied containers must be decontaminated, as by triple rinsing, before refilling. Decontamination of plastic containers has presented particularly difficult problems, thereby often making reuse of such containers expensive.

There has been a particular need for a refillable/reusable container system for storing, transporting and dispensing precisely metered quanitities of certain liquid products which are expensive, such as certain types of liquid fertilizers and pesticides.

Reference may be made to U.S. Pat. Nos. 948,325, 1,994,334, 2,069,005, 2,195,321, 2,089,777, 2,195,321, 2,258,637, 4,597,507 and U.S. Pat. No. 4,630,759 for container systems generally in the field of this invention.

SUMMARY OF THE INVENTION

Among the several objects of this invention may be noted the provision of an improved reusable container system, an improved container for such a system, and an improved method of using such a system; the provision of such a system wherein a container of the system is provided with tamper-evident features indicating whether the container has been contaminated (as by unauthorized attempts to refill) when it is returned for refilling; the provision of such a system which reduces the amount of time and money spent in decontamination of returned containers; the provision of such a system wherein a container of the system is designed to discourage unauthorized attempts to refill the container; the provision of such a system which is applicable to plastic containers as well as metal containers; the provision of such a system which utilizes a container which is readily connectable in the field to any standard pump for removing material from the container, such as an on-site metering pump for pumping liquid from the container and dispensing precisely metered quantities of the liquid; the provision of such a system which is environmentally safe; the provision of such a system which is easy to use; the provision of such a system which is economical; and the provision of such a system which facilitates the safe refill and reuse of the container.

Generally, a reusable container system of the present invention comprises a container for holding a bulk quantity of liquid or other fluent material, the container being adapted to be filled with material at a first location and unloaded at a second location, and pump means for pumping material out of the container and the second location. The container has top, bottom and side walls, and a port in the top wall of the container. A closure is provided for closing the port, the closure having a tamper-evident connection with the container for indicating removal of the closure from the container, and a passage through the closure. Suction tube means is attached to the closure and extends down into the container. The suction tube means has an upper end communicating with the passage through the closure and a lower end adjacent the bottom wall of the container communicating with the interior of the container for suction of liquid from the container up through the suction tube means and then out of the container via said passage. A one-way check valve in the suction tube means permits suction of liquid out of the container through the suction tube means but prevents flow of liquid into the container through the suction tube means. The system also includes connector means for releasably connecting the pump means and the container with the pump means in fluid-flow communication with the passage through the closure and the suction tube means whereby, after arrival of the container at the aforsaid second location, the pump means is adapted to be releasably connected to the container for removal of liquid from the container and disconnected from the container after the container is emptied for delivery of the container to a location different from the second location for refilling.

Briefly, the method of this invention involves the steps of (1) filling a container of the type described above at a first location, (2) transporting the container from the first location to a second location for removal of liquid from the container, (3) releasably connecting pump means to the closure at the second location so that the pump means is in fluid-flow communication with the passage through the closure and the suction tube means, (4) operating the pump means to remove liquid from the container via the suction tube means and the passage in the closure, (5) when the container is empty, disconnecting the pump means from the closure, and (6) transporting the empty container to a location different from said second location for refilling of the container.

Other objects and features will be in part apparent and in part pointed out hereinafter.

BRIEF DESCRIPTION OF THE DRAWINGS

Corresponding parts are indicated by corresonding reference numerals throughout the several views of the drawings.

DESCRIPTION OF THE PREFERRED EMBODIMENT

Figure 1:
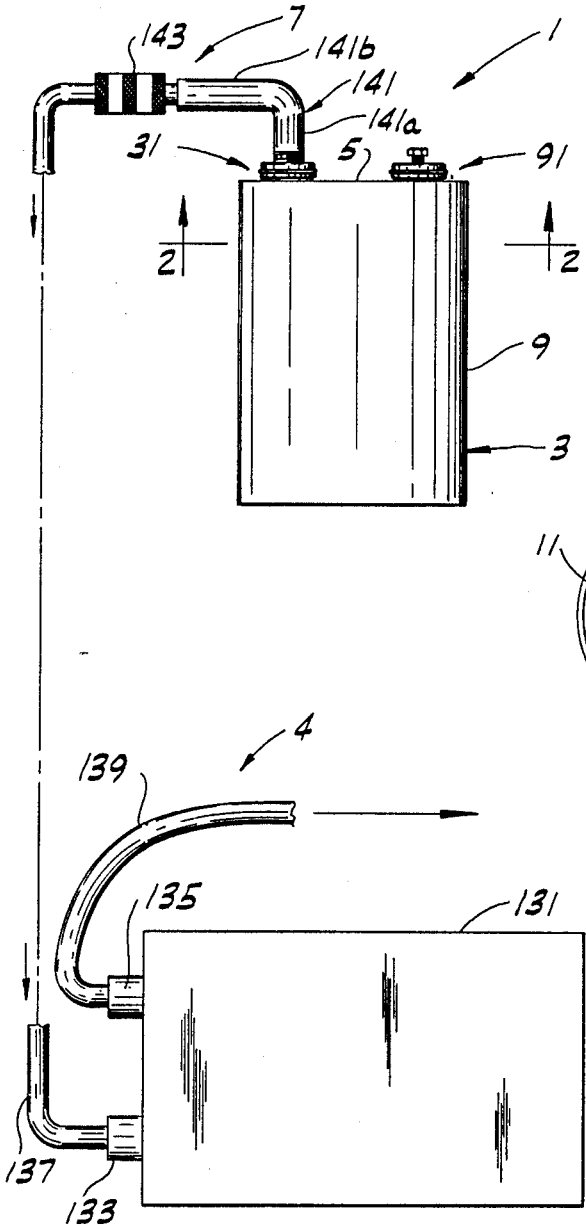
FIG. 1 is a schematic view of a reusable container system of this invention.

Referring now to the drawings, and first to FIG. 1, a reusable container system of the present invention is indicated in its entirety by the reference numeral 1. As shown, the system comprises a reusable container, generally designated 3, for holding a bulk quantity of liquid or other fluent material, such as liquid fertilizer, pump means, generally designated 4, for pumping liquid from the container for application by a user, and connector means, generally designated 7, for releasably connecting the pump means 5 and the container 3.

The container 3 is a generally cylindric container having a top wall 5, a bottom wall 7 and a cylindric side wall 9. The top wall 5 of the container has a pair of openings therein, one constituting a port 11 through which liquid may be removed from the container and the other constituting a port 13 through which liquid may delivered to the container, the latter port 13 also functioning as a vent for venting the container as it is filled and emptied. For purposes of description, port 11 shall hereinafter be referred to as a discharge port and port 13 as a vent port. Two internally threaded connecting rings 15, 17, project up from the top wall of the container around the port openings 11 and 13, respectively. These connecting rings may be integrally formed with the top wall 5 of the container, or they may be separate parts affixed to the top wall. The bottom wall 7 of the container is crowned at its center to form an annular channel or sump indicated generally at 21 adjacent the side wall 9 of the container.

The discharge port 11 in the top wall 5 of the container is closed by a closure generally designated 31 comprising a closure member 33 having an outer annular flange 34 and an inner annular flange 35 spaced radially inwardly from the outer flange, the outer flange 34 being formed with external threads 36 engageable with the internal threads of the connecting ring to enable the closure member to be threadably applied to the ring. The closure 31 also includes a cap 37 rigidly affixed to the closure member 33. The cap has an annular top wall 38 overlying the closure member and a depending peripheral skirt 39. The inner surface of the skirt 39 and the outer surface of the connecting ring 15 are formed with interengageable ratchet members (teeth and pawls) designated 41 and 43, respectively, (FIG. 4) which permit the closure 31 to be threaded on the connecting ring 15 but which prevent the closure from being removed from the ring without destroying at least some of the ratchet members. It will be understood, therefore, that the ratchet members 41, 43 constitute a tamper-evident connection between the closure and the container for indicating removal of the closure from the container. The closure member 33 has a central vertical passage 47 therethrough formed with internal threads for receiving a closure element in the form of a screw plug 51 threadable into the passage for closing the latter and sealing it against leakage of liquid therepast. The screw plug has a central recess 53 therein sized and shaped for receiving a suitable tool (not shown) to rotate the plug into and out of the passage.

Indicated generally at 61 is suction tube means in the container extending down from the closure member 33 into the interior of the container. Suction tube means comprises a tubular fitting 63 having a relatively large-diameter cylindric upper portion **63*a* affixed (e.g., heat-welded) to the flange 35 of the closure member 33, a smaller-diameter lower tubular portion 63*b*, and an annular downwardly sloping (funnel-shaped) transition 63*c* integrally joining the upper and lower portions. The suction tube means also includes a suction tube 71 (sometimes referred to as a "dip" tube) extending down from the fitting 63 to the sump 23. The suction tube 71 has an upper end telescopically received in the lower tubular portion 63*b* of the fitting 63 and a lower end which is cut on an angle, as indicated at 73, to prevent the tube from sealing against the bottom wall 7 of the container when suction is applied to the tube to pump liquid out of the container. The telescopic fit between the suction tube 71 and the fitting 63 enables the suction tube to be extended down to a point at which the bottom of the tube is in contact with the the bottom wall 7 of the container in the sump 21 for removing a maximum amount of liquid from the container, while permitting automatic upward retraction of the suction tube into the fitting in the event the top and bottom walls 5, 7 of the container deflect toward one another. Spring means comprising a coil compression spring 74, for example, urges the suction tube toward the bottom wall of the container. The lower end of the suction tube is held in proper position in the sump 21 by means of a pin 75** extending up from the bottom wall of the container into the dip tube.

Located in the lower portion **63*b* of the tubular fitting 63 above the upper end of the suction tube is a one-way check valve 81 which permits upward flow of liquid through the suction tube during removal of liquid from the container, but which prevents reverse (downward) flow of liquid into the container, thereby preventing unauthorized refilling of the container through the suction tube. As illustrated, the check valve 81 is a one-piece valve comprising a cylindric valve body 81*a* formed at its upper end with a pair of upwardly-coned valve flaps, each designated 81*b*, of resilient material. The valve flaps 81*b* are adapted to open to permit upward flow therethrough and are biased by the natural resilience of the valve material (e.g., rubber) toward a closed position (see FIG. 3) to prevent downward flow through the suction tube. It will be understood that the check valve 81 may take other forms without departing from the scope of this invention. A tamper-evident element in the form of a disc 85 is disposed in the fitting 63 immediately above the check valve 81 to indicate any attempts to tamper with the check valve, as would occur during attempted unauthorized refilling of the container. The disc 85, which is permanently secured in place by suitable means, is perforated (FIG. 4**) to permit the flow of liquid therepast. The disc also serves as a filter.

Figure 3:
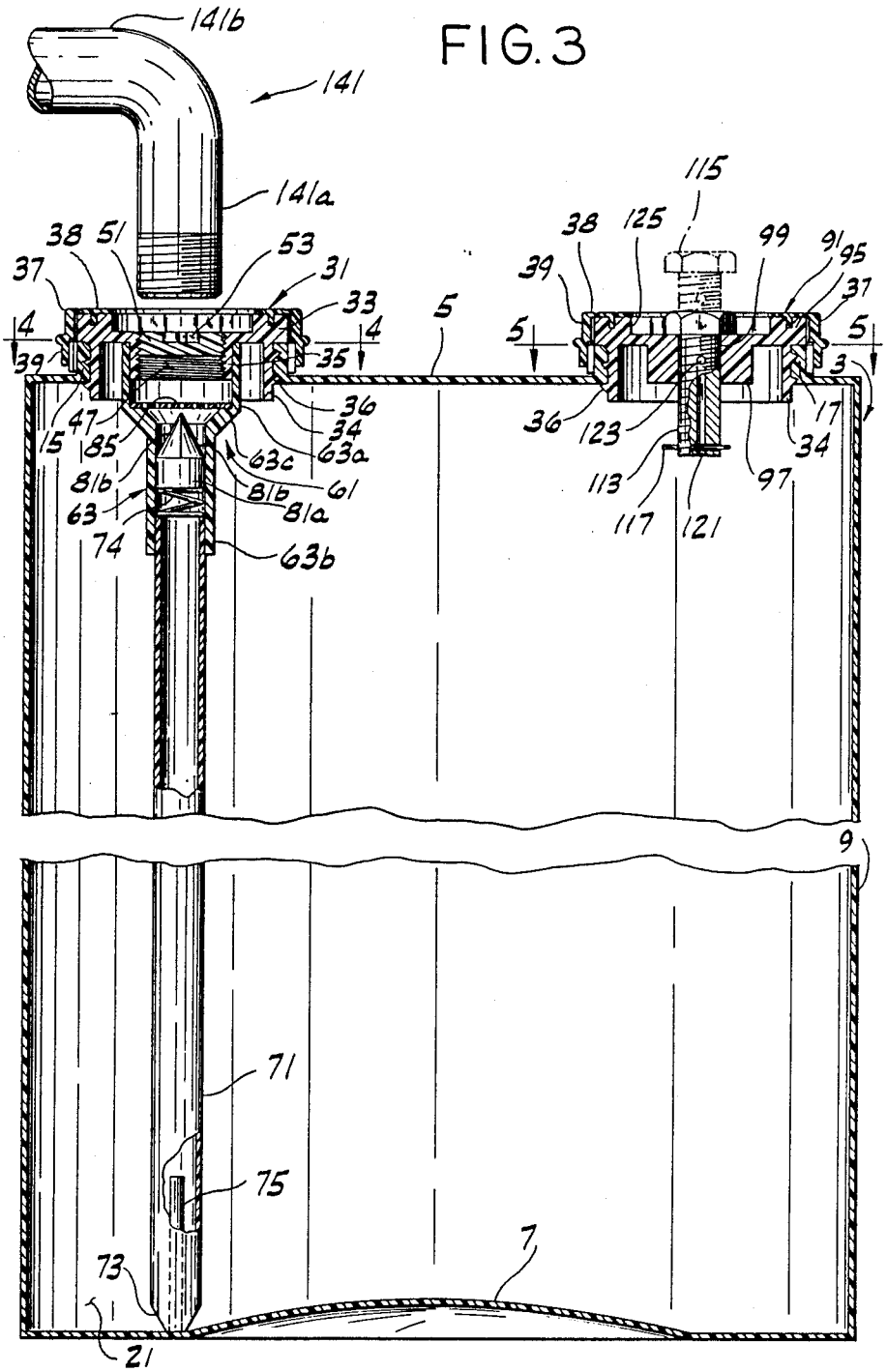
FIG. 3 is a side elevation view, in cross section, of a container of the system of FIG. 1.
Figure 4:
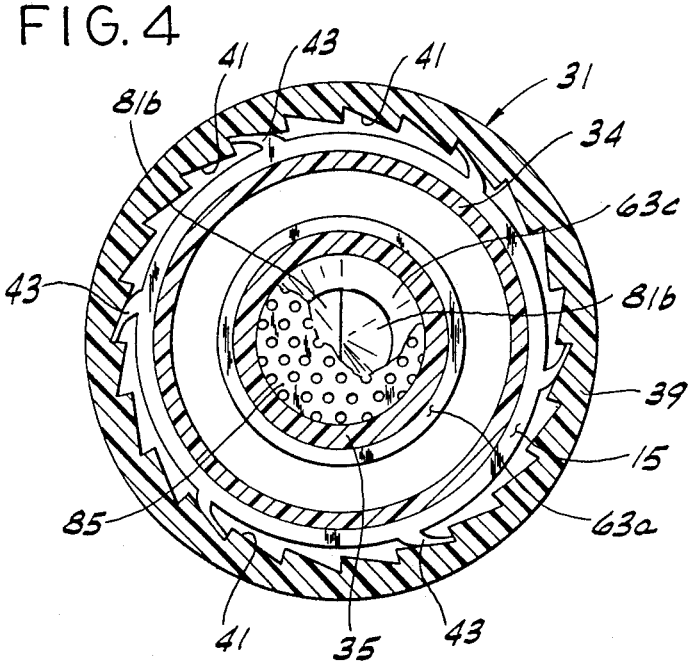
FIG. 4 is a horizontal section taken on line 3—3 of FIG. 2.
Figure 5:
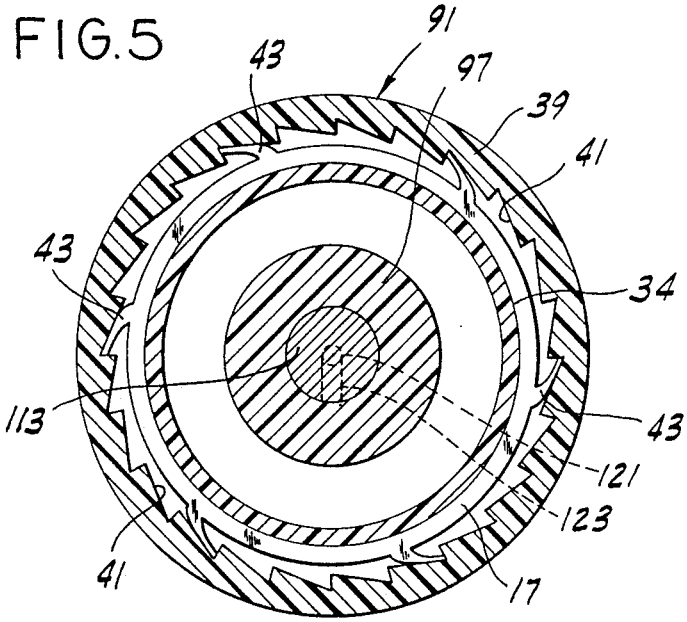
FIG. 5 is a horizontal section taken on line 4—4 of FIG. 2.

Indicated generally at 91 in FIGS. 3 and 4 is a closure for closing the vent port 13. As best illustrated in FIG. 3, this closure 93 is preferably (but not necessarily) essentially identical to the closure 31 for the discharge port 11, and corresponding parts are thus designated by the same reference numerals. The only difference is that vent closure 91 comprises a closure member 95 having a cylindric body 97 with a vertical threaded bore 99 therethrough instead of the annular flange 35 of closure 31. The connecting ring 17 is formed with ratchet members 43 engageable with the ratchet members 41 of the closure 91.

A vent bolt 113 having a head 115 at its upper end is threadable in the bore 99 through the vent closure member 95. A cotter pin 117 (constituting stop means) is removably inserted through a radial bore in the lower end of the vent bolt and is engageable with the body 97 of the vent closure member for preventing the bolt from being removed from the bore 99. The bolt 113 has vent passaging therein comprising a first axial reach 121 of passage communicating with the interior of the container and extending axially of the bolt from the lower end of the bolt upwardly to a point below the head 115 of the bolt, and a second radial reach 123 of passage extending radially of the bolt from the upper end of the first reach to the outer surface of the bolt. The arrangement is such that the vent bolt 113 is threadable in the bore 97 between a non-venting position (shown in solid lines in FIG. 3) wherein the radial reach 123 of passage is blocked by the body 97 of the vent closure member 95 and thus sealed from ambient air, and a venting position (shown in phantom lines) wherein the radial reach 123 is disposed above the vent closure member 95 and communicates with ambient air for venting the container 3.

As described so far, the container 3 and its various components can be fabricated from any suitable material, including either plastic or metal, or a combination thereof.

Referring to FIG. 1, pump means 4 comprises a pump 131 having an intake 133 and an outlet 135, an intake line 137 for delivery of liquid from the container 3 to the intake 133, and a discharge line 139 connected to the outlet 135 through which quantities of liquid may be dispensed for application by the user. Pump 131 may be a metering pump, for example, capable of precisely dispensing metered desired quantities of liquid. However, it will be understood that any suitable pump can be used with the container 3 of the present invention. To facilitate use with a non-metering pump, the container 3 may have a transparent vertical stripe (not shown), or the equivalent, at one side of the container to enable the user to determine how much material has been removed from the container. For additional accuracy, graduations of a suitable nature may be placed adjacent the transparent stripe indicating the volume unloaded or the volume remaining in the container.

Figure 2:
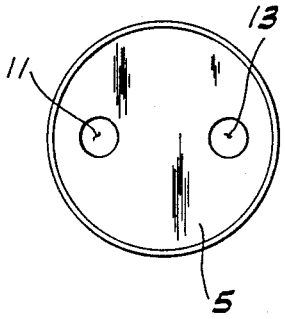
FIG. 2 is a horizontal section taken on line 2—2 of FIG. 1.

Connector means 7 includes a tubular connector 141 adapted for releasable connection to the port closure member 33, and a quick-connect coupling 143 for connecting the tubular connector 141 and the intake line 137 to the pump 131. Although other configurations are contemplated, the tubular connector 141 is illustrated as being L-shaped, having a first generally vertical section **141*a* and a second generally horizontal section 141*b* generally at right angles to the first section (FIG. 2). The lower end of the vertical section 141*a* is threaded so that it may be screwed into the passage 47 in the port closure 33 after the screw plug 51 is removed. The horizontal section 141*b* of the connector is preferably dimensioned to extend laterally outwardly from the first section to a point beyond the top wall 5 of the container 3, thereby preventing liquid from dripping on the container when the intake line 137 is connected and disconnected to the tubular connector 141 via the quick-connect coupling 143**. The quick-connect coupling may be any suitable commercially available quick-connect coupling.

In accordance with the method of this invention, a container 3 is initially filled with liquid (or other fluent material) at a suitable location by a suitable supplier of the liquid. Filling is preferably through the vent port 13. The vent port closure 91 is applied to the container after the filling operation, making certain that the vent bolt 113 is threaded to its non-venting position before transport of the container into the field for use by a consumer.

To unload the container a user simply removes the screw plug 51 and threads the tubular connector 141 into the passage 47 through the port closure member 33. The connector is then coupled to the pump intake line 137 via the quick-connect coupling 143. Immediately prior to pumping liquid from the container, the vent bolt 113 should be threaded up to its venting position. As the container is emptied, remnant liquid will drain into the sump area 21 for withdrawal, thereby minimizing the amount of liquid which cannot be pumped from the container.

In accordance with this invention, unauthorized attempts to refill the container 3 are discouraged by the construction of the container. For example, discharge port closure 31 and suction tube 71 cannot be removed without detection because of the interengaging ratchet members 41, 43 on the closure member 33 and port connecting ring 15. Moreover, the tamper-evident disc 85 above the check valve 81 prevents undetected manipulation of the check valve (e.g., prying it open) in an attempt to fill through the passage 47 and suction tube. The vent port closure 91 is similarly tamper-proof, since it cannot be removed from the vent port 13 without destroying the ratchet members 41, 43, and since the vent bolt 113 cannot be removed from the vent bore 111.

After the container 3 is emptied, it is returned to an authorized filler for refilling. The refiller first checks for evidence of tampering to determine whether the container has been contaminated. If there is no such evidence, thereby establishing that the container is not contaminated, the vent port closure 91 is forcibly removed from the container (thereby destroying the ratchet members 41, 43 of the vent port and closure), the container refilled through the vent port opening 13, and a new vent closure 91 installed on the container for shipment back to the user. If the container has been tampered with, indicating possible contamination of the container, the discharge port closure 31 and suction tube assembly are forcibly removed, together with the vent port closure 91, and the container either decontaminated in conventional fashion or disposed of.

It is believed that use of the system of the present invention will substantially reduce the need for for either decontamination or disposal of contaminated containers, thereby decreasing the waste disposal problem and resulting in substantial cost savings. The system will also permit containers 3 of the system to be recycled.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A reusable container system comprising a container for holding a bulk quantity of liquid or other fluent material, said container being adapted to be filled with said material at a first location and transported to a second location for unloading off material from the container, pump means for pumping said material out of the container at said second location, said container having top, bottom and side walls, a port in the top wall of the container through which material in the container may be unloaded by said pump means, a closure for closing said port, said closure having a tamper-evident connection with said container for indicating removal of the closure from the container, and a passage through the closure, suction tube means attached to said closure and extending down into the container, said suction tube means having an upper end communicating with said passage through the closure and a lower end adjacent the bottom wall of the container communicating with the interior of the container for suction of liquid from the container up through said suction tube means and then out of the container via said passage, a one-way check valve in said suction tube means permitting flow of liquid out of the container through said suction tube means but preventing flow of liquid into the container through said suction tube means, and connector means for releasably connecting said pump means and said container with said pump means in fluid-flow communication with said passage through the closure whereby, after arrival of said container at said second location, said pump means is adapted to be releasably connected to the container for removal of liquid from the container and disconnected from the container after the container is emptied for transport of the container to another location for refilling, said suction tube means comprising a tubular fitting attached to said closure, and a suction tube connected to said tubular fitting and extending downwardly to a point adjacent the bottom of the container, said suction tube and fitting being movable relative to one another to accommodate, for example, deformation of the top and bottom walls of the container, and spring means urging said suction tube downwardly relative to said fitting toward the bottom wall of the container.

2. A reusable container system as set forth in claim 1 further comprising a tamper-evident element associated with said check valve for indicating an attempt to tamper with said check valve.

3. A reusable container system as set forth in claim 2 wherein said tamper-evident element comprises a perforated disc disposed in said passage above said check valve.

4. A reusable container system as set forth in claim 1 wherein said suction tube has a telescopic sliding fit with said fitting.

5. A reusable container system as set forth in claim 1 further comprising a sump at the bottom of the container, and means for holding the lower end of the suction tube in the sump.

6. A reusable container system as set forth in claim 5 wherein said holding means comprises a pin extending up from the sump receivable in the lower end of the suction tube.

7. A reusable container system as set forth in claim 1 further comprising a closure element threadable in said passage in said closure for closing the passage.

8. A reusable container system as set forth in claim 7 wherein said closure element has a recess therein for receiving a tool to rotate the closure element.

9. A reusable container system as set forth in claim 1 further comprising a threaded connecting ring projecting up from the top wall of the container around said port, said closure being threadable on said ring, said tamper-evident connection comprising interengageable ratchet members on said closure and ring permitting said closure to be threaded onto said ring but preventing said closure from being removed from the ring without destroying said ratchet members.

10. A reusable container system as set forth in claim 1 further comprising a vent port in the top wall of the container and a vent closure for the vent port having a tamper-evident connection with the container.

11. A reusable container system as set forth in claim 10 wherein said vent closure has a generally vertical threaded bore therethrough, and a vent bolt threadable in said bore, said vent bolt having upper and lower ends and vent passaging therethrough comprising a first reach of passage communicating with the interior of the container and a second reach adapted to provide communication between said first reach and ambient air outside of the container, said vent bolt being threadable in said passage between a non-venting position wherein said second reach of passage cannot communicate with ambient air and a venting position wherein said second reach communicates with ambient air for venting the container.

12. A reusable container system as set forth in claim 11 wherein said vent bolt has stop means at its lower end engageable with said vent closure for preventing the vent bolt from being removed from said bore.

13. A reusable container system as set forth in claim 11 further comprising a threaded connecting ring projecting up from the top wall of the container around said vent port, said vent closure being threadable on said ring, said tamper-evident connection comprising interengageable ratchet members on said ring and vent closure permitting the vent closure to be threaded onto said ring but preventing the vent closure from being removed from the ring without destroying said ratchet members.

14. A reusable container system as set forth in claim 1 wherein said connector means comprises a tubular connector receivable in said passage.

15. A reusable container system as set forth in claim 14 wherein said pump means comprises a pump having an intake for intake of liquid from said container and an outlet for dispensing quantities of liquid, an intake line for flow of liquid to the intake of the pump, and a quick-connect coupling for coupling the intake line and said tubular connector.

16. A reusable container system as set forth in claim 15 wherein said passage in said closure is internally threaded and said tubular connector is externally threaded for enabling the tubular connector to be threaded into said passage.

17. A reusable container system as set forth in claim 14 wherein said tubular connector is generally L-shaped, having a first section adapted for connection to said closure with the first section extending generally vertically upwardly from the closure, and a second section generally at right angles to the first section adapted for connection to said quick-connect coupling, said second section having a length sufficient to extend generally horizontally from the first section to a point beyond the top wall of the container to prevent liquid from dripping onto the container.

18. A reusable container system comprising a container for holding a bulk quantity of liquid or other fluent material, said container being adapted to be filled with said material at a first location and transported to a second location for unloading of material from the container.

pump means for pumping said material out of the container at said second location, said container having top, bottom and side walls, a port in the top wall of the container through which material in the container may be unloaded by said pump means, a closure for closing said port, said closure having a tamper-evident connection with said container for indicating removal off the closure from the container, and a passage through the closure, suction tue means attached to said closure and extending down into the container, said suction tube means having an upper end communicating with said passage through the closure and a lower end adjacent the bottom wall of the container communicating with the interior of the container for suction tube means and then out of the container via said passage.

a one-way check valve in said suction tube means permitting flow of liquid out off the container through said suction tube means but preventing flow of liquid into the container through said suction tube means, connector means for releasably connecting said pump means and said container with said pump means in fluid-flow communication with said passage through the closure whereby, after arrival of said container at said second location, said pump means is adapted to be releasably connected to the container for removal of liquid from the container and disconnected from the container after the container is emptied for transport of the container to another location for refilling, said suction tube means comprising a tubular fitting attached to said closure, and a suction tube having a telescopic sliding fit with said fitting and extending downwardly therefrom, and spring means urging said suction tube downwardly relative to said fitting toward the bottom wall of the container.

19. A reusable container system comprising a container for holding a bulk quantity of liquid or other fluent material, said container being adapted to be filled with said material at a first location and transported to a second location for unloading of material from the container, pump means for pumping said material out of the container at said second location, said container having top, bottom and side walls, a port in the top wall of the container through which material in the container may be unloaded by said pump means, a closure for closing said port, said closure having a tamper-evident connection with said container for indicating removal of the closure from the container, and a passage through the closure, suction tube means attached to said closure and extending down into the container, said suction tube means having an upper end communicating with said passage through the closure and a lower end adjacent the bottom wall of the container communicating with the interior of the container for suction of liquid from the container up through said suction tube means and then out of the container via said passage, a one-way check valve in said suction tube means permitting flow of liquid out of the container through said suction tube means but preventing flow of liquid into the container through said suction tube means, and connector means for releasably connecting said pump means and said container with said pump means in fluid-flow communication with said passage through the closure whereby, after arrival of said container at said second location, said pump means is adapted to be releasably connected to the container for removal of liquid from the container and disconnected from the container after the container is emptied for transport of the container to another location for refilling.

said suction tube means comprising a tubular fitting attached to said closure, and a suction tube connected to said tubular fitting and extending downwardly to a point adjacent the bottom of the container, said suction tube and fitting being movable relative to one another to accommodate, for example, deformation of the top and bottom walls of the container, and a tamper-evident element associated with said check valve for indicating an attempt to tamper with said check valve, said check valve being disposed in said tubular fitting and said tamper-evident element being disposed in said fitting above said check valve.

20. A reusable container system as set forth in claim 19 wherein said tubular fitting has a relatively large-diameter upper portion attached to said closure, a smaller-diameter lower portion connected to the upper end of said suction tube, and a funnel-shaped transition joining said upper and lower portions.

21. A reusable container system as set forth in claim 20 wherein said check valve is disposed in said smaller-diameter lower portion of the tubular fitting and said tamper-evident element is disposed thereabove in said relatively large-diameter upper portion of the tubular fitting at the juncture of the upper portion and the transition.

22. A reusable container system as set forth in claim 19 wherein said tamper-evident element is perforated to permit the flow of liquid therethrough.

23. A reusable container for holding a bulk quantity of liquid or other fluent material, said container being adapted to be filled with material at a first location and transported to a second location for unloading of material from the container by pump means, said container comprising top, bottom and side walls, a port in the top wall of the container, a closure for closing said port, said closure having a tamper-evident connection with said container for indicating removal of the closure from the container, and a passage through the closure, suction tube means attached to said closure and extending down into the container, said suction tube means having an upper end communicating with said passage through the closure and a lower end adjacent the bottom wall of the container communicating with the interior of the container for suction of liquid from the container up through said suction tube means and then out of the container via said passage, said suction tube means comprising a tubular fitting attached to said closure, and a suction tube connected to said tubular fitting and extending downwardly to a point adjacent the bottom of the container, said suction tube and fitting being movable relative to one another to accommodate, for example, deformation of the top and bottom walls of the container and spring means urging said suction tube downwardly relative to said fitting toward the bottom wall of the container, and a one-way check valve in said suction tube means permitting flow of liquid out of the container through said suction tube means but preventing flow of liquid into the container through said suction tube means, said closure being formed for releasable connection of said pump means to the closure with the pump means in fluid-flow communication with said passage through the closure whereby, after arrival of said container at said second location, said pump means is adapted to be releasably connected to the closure for removal of liquid from the container and disconnected from the closure after the container is emptied for transport of the container to a location different from said second location for refilling.

24. A reusable container as set forth in claim 23 further comprising a tamper-evident element associated with said check valve for indicating an attempt to tamper with said check valve.

25. A reusable container as set forth in claim 24 wherein said tamper-evident element comprises a perforated disc disposed in said passage above said check valve.

26. A reusable container as set forth in claim 23 wherein said suction tube has a telescopic sliding fit with said fitting.

27. A reusable container as set forth in claim 23 further comprising a sump at the bottom wall of the container, and means for holding the lower end of the suction tube in the sump.

28. A reusable container as set forth in claim 27 wherein said holding means comprises a pin extending up from the sump receivable in the lower end of the suction tube.

29. A reusable container as set forth in claim 23 further comprising a closure element threadable in said passage through said closure for closing the passage.

30. A reusable container as set forth in claim 29 wherein said closure element has a recess therein for receiving a tool to rotate the closure element.

31. A reusable container as set forth in claim 23 further comprising a threaded connecting ring projecting up from the top wall of the container around said port, said closure being threadable on said ring, said tamper-evident connection comprising interengageable ratchet members on said closure and ring permitting said closure to be threaded onto said ring but preventing said closure from being removed from the ring without destroying said ratchet members.

32. A reusable container as set forth in claim 31 wherein said vent closure has a generally vertical threaded bore therethrough, and a vent bolt threadable in said bore, said vent bolt having upper and lower ends and vent passaging therethrough comprising a first reach of passage communicating with the interior of the container and a second reach adapted to provide communication between said first reach and ambient air outside of the container, said vent bolt being threadable in said passage between a non-venting position wherein said second reach of passage cannot communicate with ambient air and a venting position wherein said second reach communicates with ambient air for venting the container.

33. A reusable container as set forth in claim 32 wherein said vent bolt has stop means at its lower end engageable with said vent closure for preventing the vent bolt from being removed from said bore.

34. A reusable container as set forth in claim 23 further comprising a vent port in the top wall of the container and a closure for the vent opening having a tamper-evident connection with the container.

35. A reusable container system for holding a bulk quantity of liquid or other fluent material, said container being adapted to be filled with material at a first location and transported to a second location for unloading of material from the container by pump means, said container comprising top, bottom and side walls, a port in the top wall of the container, a closure for closing said port, said closure having a tamper-evident connection with said container for indicating removal of the closure from the container, and a passage through the closure, suction tube means attached to said closure and extending down into the container, said suction tube means having an upper end communicating with said passage through the closure and a lower end adjacent the bottom wall of the container communicating with the interior of the container for suction of liquid from the container up through said suction tube means and then out of the container via said passage, a one-way check valve in said suction tube means permitting flow of liquid out of the container through said suction tube means but preventing flow of liquid into the container through said suction tube means, said closure being formed for releasable connection of said pump means to the closure with the pump means in fluid-flow communication with said passage through the closure whereby, after arrival of said container at said second location, said pump means is adapted to be releasably connected to the closure for removal of liquid from the container and disconnected from the closure after the container is emptied for transport of the container to a location different from said second location for refilling, said suction tube means comprising a tubular fitting attached to said closure, and a suction tube having a telescopic sliding fit with said fitting and extending downwardly therefrom, and spring means urging said suction tube downwardly relative to said fitting toward the bottom wall of the container.

36. A reusable container for holding a bulk quantity of liquid or other fluent material, said container being adapted to be filled with material at a first location and transported to a second location for unloading of material from the container by pump means, said container comprising top, bottom and side walls, a port in the top of wall of the container, a closure for closing said port, said closure having a tamper-evident connection with said container for indicating removal of the closure from the container, and a passage through the closure, suction tube means attached to said closure and extending down into the container, said suction tube means having an upper end communicating with said passage through the closure and a lower end adjacent the bottom wall of the container communicating with the interior of the container for suction of liquid from the container up through said suction tube means and then out of the container via said passage, said suction tube means comprising a tubular fitting attached to said closure, and a suction tube connected to said tubular fitting and extending downwardly to a point adjacent the bottom of the container, said suction tube and fitting being movable relative to one another to accommodate, for example, deformation of the top and bottom walls of the container, and a one-way check valve in said suction tube means permitting flow of liquid out of the container through said suction tube means but preventing flow of liquid into the container through said suction tube means, said closure being formed for releasable connection of said pump means to the closure with the pump means in fluid-flow communication with said passage through the closure whereby, after arrival of said container at said second location, said pump means is adapted to be releasably connected to the closure for removal of liquid from the container and disconnected from the closure after the container is emptied for transport of the container to a location different from said second location for refilling, and a tamper-evident element associated with said check valve for indicating an attempt to tamper with said check valve, said check valve being disposed in said tubular fitting and said tamper-evident element being disposed in said fitting above said check valve.

37. A reusable container as set forth in claim 36 wherein said tubular fitting has a relatively large-diameter upper portion attached to said closure, a smaller-diameter lower portion connected to the upper end of the suction tube, and a funnel-shaped transition joining said upper and lower portions.

38. A reusable container as set forth in claim 37 wherein said check valve is disposed in said smaller-diameter lower portion of the tubular fitting and said tamper-evident element is disposed thereabove in said relatively large-diameter upper portion of the tubular fitting at the juncture of the upper portion and the transition.

39. A reusable container as set forth in claim 36 wherein said tamper-evident element is perforated to permit the flow of liquid therethrough.

* * * * *

UNITED STATES PATENT AND TRADEMARK OFFICE

CERTIFICATE OF CORRECTION

PATENT NO. : 4,949,878

DATED : August 21, 1990

INVENTOR(S) : Stephen V. Jacobi

It is certified that error appears in the above-identified patent and that said Letters Patent is hereby corrected as shown below:

Column 6, claim 1, line 50, "off" should read ---of---.

Column 9, claim 18, line 1, "tue" should read ---tube---.

Column 9, claim 18, lines 6-7, "suction tube" should read ---suction of liquid from the container up through said suction tube---.

Signed and Sealed this

Ninth Day of March, 1993

*Attest:*

STEPHEN G. KUNIN

*Attesting Officer*

*Acting Commissioner of Patents and Trademarks*